US010522905B2

(12) United States Patent
Ariza Baquero et al.

(10) Patent No.: US 10,522,905 B2
(45) Date of Patent: Dec. 31, 2019

(54) ANTENNA FOR LOW FREQUENCY COMMUNICATION WITHIN A VEHICLE ENVIRONMENT AND LOW FREQUENCY COMMUNICATION SYSTEM

(71) Applicant: Premo, S.A., Campanillas (ES)

(72) Inventors: Miguel Angel Ariza Baquero, Malaga (ES); Claudio Canete Cabeza, Benalmadena (ES); Francisco Ezequiel Navarro Perez, Barcelona (ES); Antonio Rojas Cuevas, Malaga (ES)

( * ) Notice: Subject to any disclaimer, the term of this patent is extended or adjusted under 35 U.S.C. 154(b) by 0 days.

(21) Appl. No.: 16/168,655

(22) Filed: Oct. 23, 2018

(65) Prior Publication Data

US 2019/0123435 A1 Apr. 25, 2019

(30) Foreign Application Priority Data

Oct. 23, 2017 (EP) ..... 17382703
Oct. 5, 2018 (EP) ..... 18382704

(51) Int. Cl.
*H01Q 1/32* (2006.01)
*H01Q 7/08* (2006.01)

(52) U.S. Cl.
CPC ..... *H01Q 1/3283* (2013.01); *H01Q 1/3241* (2013.01); *H01Q 7/08* (2013.01)

(58) Field of Classification Search
CPC ..... H01Q 1/3283; H01Q 1/3241; H01Q 7/08; H01Q 7/00; H01Q 1/50; H01Q 1/36; H01Q 1/325; H01Q 1/241
See application file for complete search history.

(56) References Cited

U.S. PATENT DOCUMENTS 6,795,032 B2 * 9/2004 Ieda ..... H01Q 1/3241 343/711
7,209,090 B2 * 4/2007 Hall ..... H01Q 7/08 343/788
10,056,687 B2 * 8/2018 Rojas Cuevas ..... H01Q 7/08
10,062,484 B2 * 8/2018 Navarro Perez ..... H01Q 1/36
2004/0252068 A1 12/2004 Hall

FOREIGN PATENT DOCUMENTS

EP 3089176 A1 2/2016
EP 3192084 A1 3/2016
EP 3089176 B1 9/2018

* cited by examiner

*Primary Examiner* — Jessica Han
*Assistant Examiner* — Michael M Bouizza
(74) *Attorney, Agent, or Firm* — Eugenio J. Torres-Oyola; Victor M. Rodriguez-Reyes; Ferraiuoli LLC

(57) ABSTRACT

An antenna for low frequency communication within a vehicle environment, low frequency communication system and uses of the antenna.

The antenna comprises a flexible or semi-flexible magnetic core of at least 500 mm, and the magnetic core incorporates a dual coil configuration that provides a first coil configuration for transmission capabilities and a second coil configuration for reception capabilities, and further including means for switching between both of said coil configurations.

7 Claims, 1 Drawing Sheet

ANTENNA FOR LOW FREQUENCY COMMUNICATION WITHIN A VEHICLE ENVIRONMENT AND LOW FREQUENCY COMMUNICATION SYSTEM

TECHNICAL FIELD

The present invention is directed, to the field of low frequency communication. In particular, the invention relates to an antenna for low frequency communication within a vehicle environment, preferably for a vehicle to vehicle (V2V) communication, and to a low frequency communication system within a vehicle.

The proposed antenna can further be used for a communication in a keyless entry system of the vehicle or for a communication with a passive or an active RFID tag used as a people locator or attached to traffic signals.

BACKGROUND OF THE INVENTION

Vehicle to vehicle (V2V) is a current challenge for autonomous vehicles.

V2V communication uses today high frequency (HF) radio communication band (GHz). This frequency allows a very long range and high bandwidth data transmission. Computers included into vehicles can interchange sensor and navigation data by this method.

However, direct localized communication with the vehicles (e.g. cars, trucks, etc.) behind is not effective by using this HF radio communication band. A fast trigger/alarm message communication from front vehicle is not possible.

With low frequency (LF) communication (kHz), one vehicle could send a trigger message to the vehicle behind at very low latencies and high speed. Bandwidth in this type of communications is not big, but enough to transmit alerts or warning messages. LF works like an "intelligent sensor". It has feedback, i.e. the vehicle sending the message could receive answer from the vehicle behind.

However, communication and reading distances between the systems/devices in a V2V communication must be 20-30 meters, minimum, and to cope with this requirement very long LF antennas are needed.

From patents EP3192084 and EP 3089176, of the same inventors of present invention, elongated flexible low frequency antennas are known. However, these antennas can only work either as a transmitter or as a receiver.

The present invention, therefore, provides a long antenna for LF communication within a vehicle environment including both transmission and reception capabilities within a same magnetic core, and a LF communication system using said antenna integrated in a vehicle, for instance a car.

Main advantages of LF communication are:

- Robustness: Low radio frequencies travel through high humidity, cold weather, snow or big storms with no problems. In case of coverage problem on V2V network, LF will continue working.
- Cheap: LF frontend electronics is simple and cheap. SOC chipsets are available in the market already. The hardware overhead needed is very small.
- Fast: Due to low processing requirements and simple electronics, latency and communication time is really low. Back and forth messages can be resolved in less than 30 ms.
- Reliable: Blocking elements (like human bodies, heavy loads, etc.) can't block the signal. Penetration and robustness in the signal is guaranteed.

LF communication allows a better physical robustness since the wavelength of these signals from 20 to 300 KHz is so long that it is very difficult to shield or attenuate it, so that the meteorological changes and the physical obstacles do not affect as much as the HF or VHF signals.

US 20040252068 discloses a magnetic core antenna system including a magnetic core and a winding network that may be configured with a non-uniform ampere-turn distribution to achieve a desired flux density in the core.

DESCRIPTION OF THE INVENTION

The antenna of this invention is based on the use of a single component providing at distinct periods of time a low-frequency transmitting antenna and a low-frequency receiving antenna.

This result can be achieved through the multiplexing technique in the time domain using the same core for the two basic functions of the antennas as it will explained in detail below, or the direct incorporation of two coils, one Rx (receiving antenna) and the other Tx (transmitting antenna) switching from one coil to another, which make it possible to use the same core for both functions.

Embodiments of the present invention provide an antenna for low frequency (LF) communication within a vehicle environment in which the antenna comprises a flexible or semi-flexible magnetic core of at least 500 mm.

Therefore according to this invention the antenna for low frequency comprises a flexible or semi-flexible magnetic core (10) of at least 500 mm, that includes or incorporates a dual coil configuration providing a first coil configuration for transmission capabilities and a second coil configuration for reception capabilities, and further including means (for example a control unit) for switching between both configurations, wherein said dual coil configuration is configured to work at a low frequency ranging between 20 kHz to 150 kHz and configured to transmit or receive data within a communication range comprised between 1 to 40 meters or 1 to 30 meters.

A previously indicated according to a first embodiment the cited dual coil configuration comprises a multifilar coil (coil including a plural number of electro-isolated filaments), with several turns, which, via a serial or parallel connection of the filaments of the coil activated in the time domain via the switching thereof (multiplexing technique), operates as a transmitter, with all the filaments of the coil in parallel, or as a receptor, with all the filaments of the coil in series.

The activation in the time domain of the multifilar coil can be performed in burst of 10-20 milli seconds under the management of a control unit.

As per an alternative embodiment the cited dual coil configuration comprises two different coils with independent functions wherein a first coil is intended for transmission capabilities and operates under low current ranging between 1-5 Amp, low inductance ranging between 100-500 uH, frequency ranging between 20-150 kHz and high electrical field and the second coil is designed for reception capabilities operates under high inductance ranging between 2-10 mH and high sensibility and frequency ranging between 20-150 kHz. Switching between one and the other coils is managed by a control unit.

Therefore, the proposed antenna can have transmission and reception capabilities (dual coil configuration), integrating in the same magnetic core full duplex performance, and allowing at the same time communication and reading distances over 30 meters. Moreover, as the antenna magnetic core is flexible or semi-flexible, easy assembly over curve surfaces without degrading efficiency is permitted.

The proposed antenna is configured for a directional V2V communication. Besides, the antenna can be configured for a communication with a passive or an active RFID tag used as a people locator or attached to traffic signals to facilitate its identification or for a keyless entry system for a vehicle.

In a preferred embodiment, the proposed antenna is arranged at a frontend and/or backend of a vehicle, for instance at the bumpers of the vehicle.

Preferably, the flexible or semi-flexible magnetic core comprises a length ranging between 500 mm to 1.2 meters. To implement this core the teachings of EP3192084 and EP 3089176 can be applied.

Moreover, in an embodiment, the flexible or semi-flexible magnetic core with dual coil configuration is preferably encapsulated in a water-resistant material to guarantee reliability in the field.

Embodiments of the present invention also provide according to another aspect a LF communication system in which the above-mentioned antenna is integrated in a vehicle.

BRIEF DESCRIPTION OF THE DRAWINGS

The previous and other advantages and features will be more fully understood from the following detailed description of embodiments, with reference to the attached figures, which must be considered in an illustrative and non-limiting manner, in which.

DETAILED DESCRIPTION OF PREFERRED EMBODIMENTS

Figure 1:
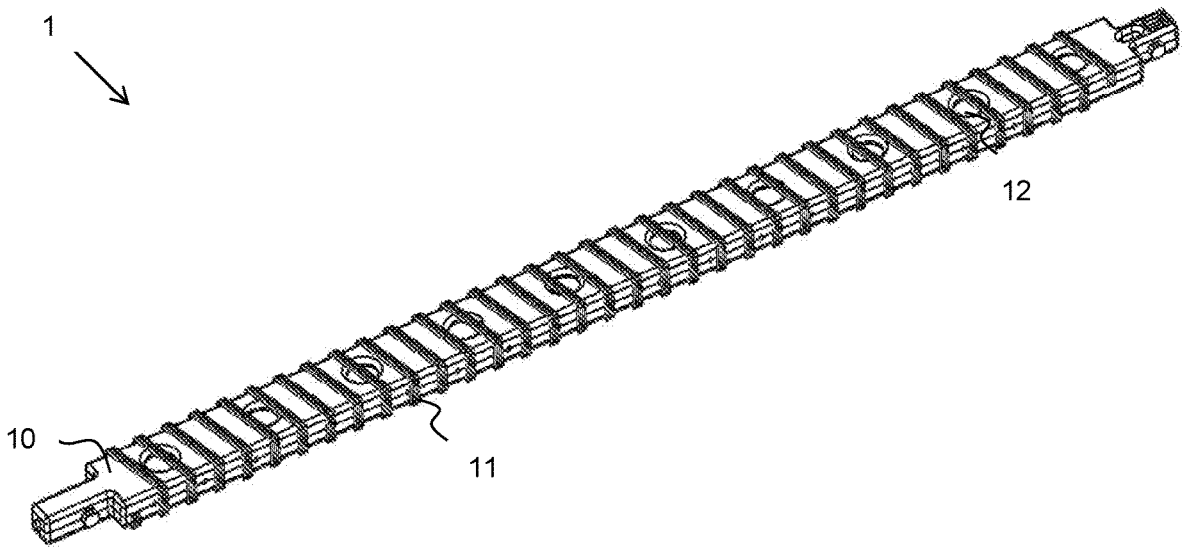
FIG. 1 is a top view of a long antenna for LF communication within a vehicle environment in accordance with an embodiment of the present invention.
Figure 2:
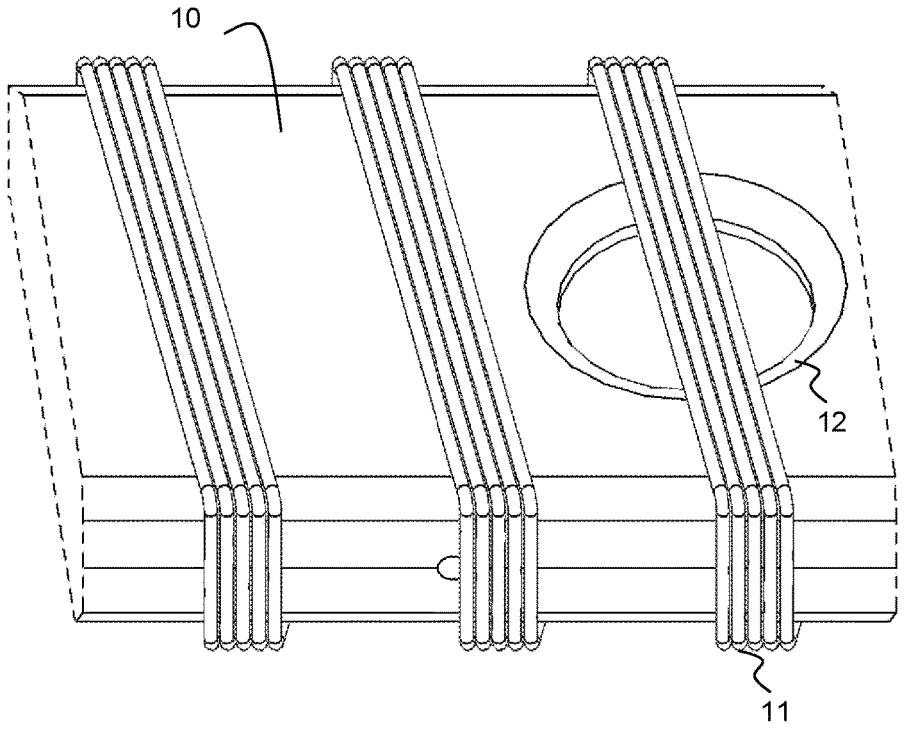
FIG. 2 shows a detail of the multifilar coil used for the antenna transmission capabilities in accordance with an embodiment of the present invention.

FIG. 1 shows a preferred embodiment of the proposed long antenna 1 for low frequency (LF) communication within a vehicle environment. As can be seen from the figure, the antenna has a flexible or semi-flexible magnetic core 10 through which a coil 11 is integrated.

As per the two alternative solutions previously explained it is proposed a dual coil configuration that comprises a first coil configuration for transmission capabilities and a second coil configuration for reception capabilities, and further including means for switching between both configurations.

In both of the solutions a first coil for transmission capabilities and a second coil for reception capabilities is provided over a common magnetic core 10.

Therefore, both capabilities, transmission and reception, are possible via a single element, i.e. the same core 10, and by implementing:

- a time domain multiplexing, managed by a control unit, over the filaments of a multifilar coil 11, i.e. via a serial or parallel connection of the filaments of the coil activated in the time domain via the switching thereof, the coil 11 operating as a transmitter, with all the filaments of the coil 11 in parallel, or as a receptor, with all the filaments of the coil 11 in series; or
- using two coils 11 with independent functions, wherein a first coil for transmission capabilities operates under low current ranging between 1-5 Amp, low inductance ranging between 100-500 uH, frequency ranging between 20-150 kHz and high electrical field and the second coil for reception capabilities operates under high inductance ranging between 2-10 mH and high sensibility and frequency ranging between 20-150 kHz; switching between one or the other coil is managed by a control unit as in the other embodiment, so that at a given moment only one of said first and second coils 11 is working.

The magnetic core 10 shown in FIG. 1, as can be seen, also includes several depressions 12 corresponding to mould positioners.

The proposed antenna 1 is mainly configured for a directional vehicle to vehicle (V2V) communication. In this case, the antenna is arranged at a frontend and backend of a vehicle (e.g. a car or a trunk, among others), preferably at the bumpers. However, the antenna 1 can be configured for other purposes, for instance, it can be configured for a communication with a passive or an active RFID tag used for example by pedestrians or cyclists to facilitate their detection or that is attached to a traffic signal for tracing it.

The length of the proposed antenna should be of at least 500 mm, preferably the length of the antenna ranges between 500 mm and 1.2 meters.

To guarantee reliability in the field, the magnetic core 10 and dual coil 11 are preferably encapsulated in a water-resistant material.

The proposed antenna can be used in multiple applications. For instance:

- Platoon: An additional link layer can be added to the system by using LF communication. This signal can penetrate metal chassis and work in harsh environments (bad weather). The platoon will be more reliable and safe by adding this technology.
- Infrastructure. Vehicles can trigger wake-up events on active or passive LF tags and devices installed in the infrastructure or carried by pedestrians or cyclists. Small sensors and actuators can be activated while vehicle is passing by, making possible the installation in rural or non-powered (battery) places.
- Emergency/Alarms. Vehicles can send high priority messages to warn other vehicles. This signal can be very directional and focused to the vehicle behind or the one in the front.
- Passive Entry. Once the LF frontend is installed in the front/rear bumpers, the vehicle has the possibility to generate a surrounding magnetic field and get located the user keyfob with precision at long range distances.
- Safety. Pedestrians, cyclist, wheelchair users, and critical zones/areas can carry over LF receivers. These receivers will work as trigger elements which can alert the vehicle to avoid entering or approaching them.

Present invention also provides a system in which the above-described antenna for LF communication is integrated into a movable support, preferably a vehicle such as a car, a trunk, a bus, etc. The LF antenna 1 will be arranged in a preferred embodiment at a frontend and/or backend of the vehicle, for instance at the bumpers thereof. Therefore, a V2V communication, a communication with a passive or an active RFID tag used as a people locator or attached to traffic signals, or a communication for a keyless entry system for the vehicle, is permitted with the proposed system.

The scope of the present invention is defined in the following set of claims.

The invention claimed is:

1. Antenna for low frequency communication within a vehicle environment, wherein said antenna comprises a flexible or semi-flexible magnetic core of at least 500 mm, wherein:

said magnetic core includes a dual coil configuration comprising a multifilar coil, with several turns around the magnetic core, providing a first coil configuration for transmission capabilities and a second coil configuration for reception capabilities;

the magnetic core further includes a switching element for switching between said first coil configuration and said second coil configuration, said switching element being configured to implement a time domain multiplexing over the filaments of said multifilar coil by connecting all the filaments of the coil in parallel to operate as a transmitter or all the filaments in series to operate as a receptor; and said antenna is configured to work at a low frequency ranging between 20 kHz to 150 kHz and configured to transmit or receive data within a communication range comprised between 1 to 40 meters.

2. The antenna of claim 1, wherein said communication range is comprised between 1 and 30 meters.

3. The antenna of claim 1, wherein the activation in the time domain of the multifilar coil is performed in bursts of 10-20 ms under the management of a control unit.

4. The antenna of claim 1, wherein the flexible or semi-flexible magnetic core comprises a length ranging between 500 mm to 1.2 meters.

5. The antenna of claim 1, wherein said flexible or semi-flexible magnetic core and multifilar coil are encapsulated in a water-resistant material.

6. A low frequency communication system, comprising:

an antenna with a magnetic core including a dual coil configuration comprising a multifilar coil, with several turns around the magnetic core, providing a first coil configuration for transmission capabilities and a second coil configuration for reception capabilities, and further including a switching element for switching between both of said coil configurations, wherein said switching element is configured to implement a time domain multiplexing over the filaments of said multifilar coil by connecting all the filaments of the coil in parallel to operate as a transmitter or all the filaments in series to operate as a receptor, and wherein said antenna is configured to work at a low frequency ranging between 20 kHz to 150 kHz and configured to transmit or receive data within a communication range comprised between 1 to 40 meters; and a movable support for said antenna, wherein said movable support is a vehicle and said antenna is arranged at a frontend and/or backend of the vehicle.

7. The system of claim 6, wherein the antenna is configured to be arranged at the bumpers of the vehicle.

* * * * *